United States Patent [19]

Guillemin et al.

[11] Patent Number: 4,734,816

[45] Date of Patent: Mar. 29, 1988

[54] DEMAGNETIZING DEVICE ESPECIALLY FOR NAVAL VESSELS

[75] Inventors: Germain Guillemin; Jean J. Periou, both of Brest, France

[73] Assignee: Thomson-CSF, Paris, France

[21] Appl. No.: 909,252

[22] Filed: Sep. 19, 1986

[30] Foreign Application Priority Data

Sep. 27, 1985 [FR] France ..... 85 14374

[51] Int. Cl.[4] ..... H01H 47/00

[52] U.S. Cl. ..... 361/149

[58] Field of Search ..... 361/143, 149, 267, 155, 361/156, 144, 145

[56] References Cited

U.S. PATENT DOCUMENTS

| | | | |
|---|---|---|---|
| 2,730,063 | 1/1956 | Richard | 361/149 |
| 2,933,059 | 4/1960 | Cohen | 114/240 R |
| 3,110,282 | 11/1963 | Foerster | 361/149 |
| 3,215,904 | 11/1965 | Burt | 361/149 |
| 4,539,619 | 9/1985 | Hill | 361/267 |

FOREIGN PATENT DOCUMENTS 0021274 7/1981 European Pat. Off. .

1303801 1/1973 United Kingdom .

*Primary Examiner*—L. T. Hix

*Assistant Examiner*—David Porterfield

*Attorney, Agent, or Firm*—Cushman, Darby & Cushman

[57] ABSTRACT

The invention concerns demagnetization devices used in particular for demagnetizing vessels or submarines in fixed stations, wherein one embodiment comprises: three sets of conductors for demagnetizing a vessel according to three directions; a direct current generator; an array of capacitors, a bridge switching device, an inductance coil; a switch allowing to select one of the three assemblies of conductors; a servo device for controlling the charge voltage of the array of capacitors; magnetometers; and a screen and keyboard allowing especially to supply a microprocessor with a reference value fixing the value of the desired residual magnetization; the demagnetization consisting of sending into each set of conductors a sequence of discharges, of smaller and smaller intensity and servo-controlled to the value of the remaining magnetization, in order to cause the magnetization to converge towards the desired value.

5 Claims, 2 Drawing Figures

FIG_1
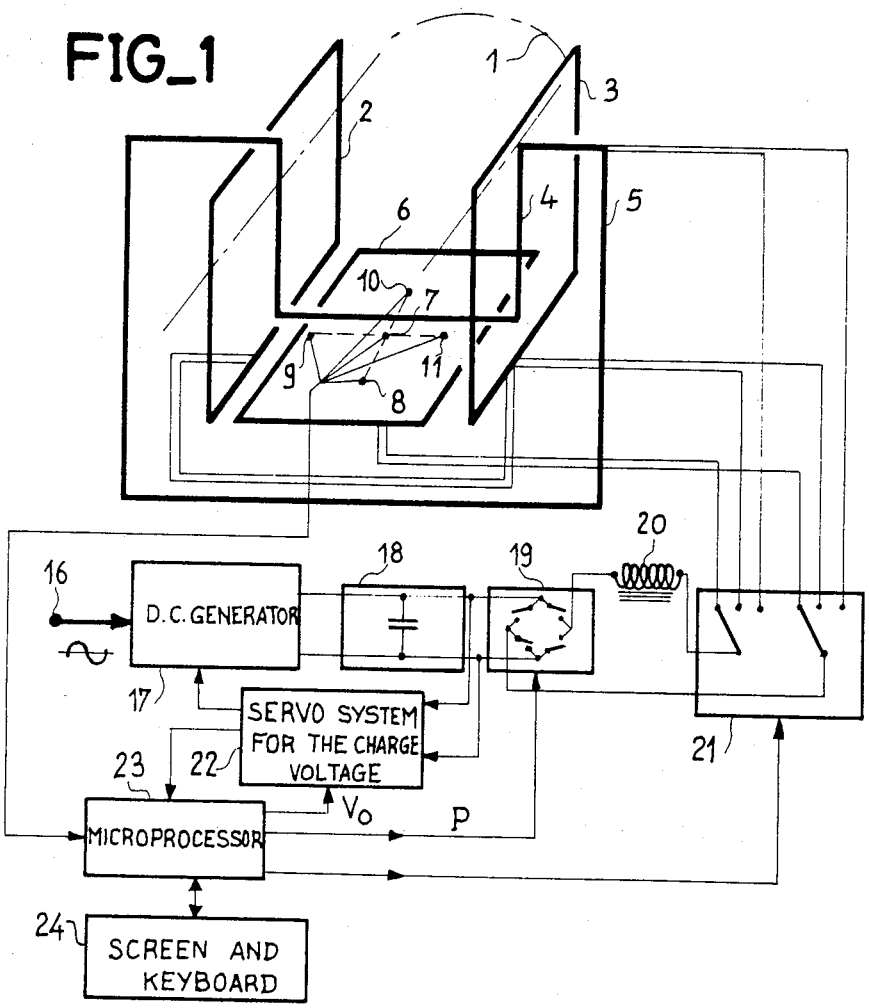
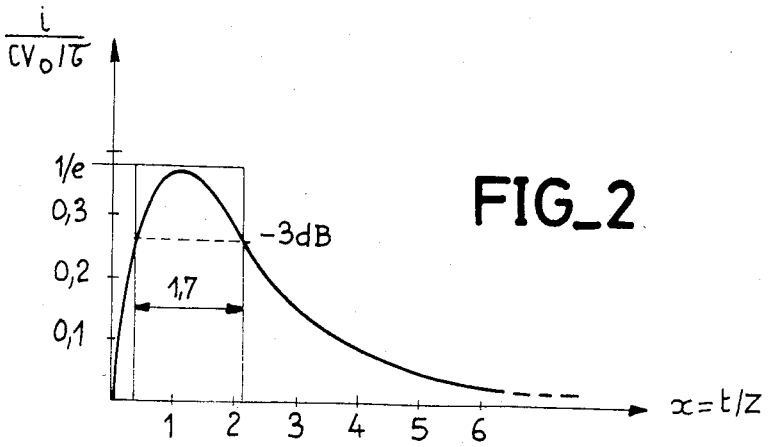
FIG_2

DEMAGNETIZING DEVICE ESPECIALLY FOR NAVAL VESSELS

FIELD OF THE INVENTION

Background of the Invention

The present invention concerns a demagnetizing device for suppressing or changing the magnetization inherent in an object, and in particular, in a naval vessel, an aircraft or a military tank.

The magnetization inherent in such an object disturbs the magnetic field of the earth. This disturbance is called the "magnetic signature" of the object and is exploited in the military field for detecting such an object. It is especially a phenomenon used for detecting submarines and for actuating mines. It is therefore of particular interest in reducing as much as possible the disturbance of the magnetic field of the earth caused by military vehicles, especially submarines and naval craft.

The magnetization of a naval vessel, for example, is constituted by a permanent magnetization which is independent from the place at which the vessel is situated and from the orientation of the vessel with respect to the magnetic field of the earth, and by the magnetization induced by the magnetic field of the earth and which is a function of the site where the vessel is situated and its orientation with respect to the magnetic field of the earth. It is not possible to neutralize definitively and completely the magnetization of a vessel due to the variations of the magnetic field of the earth in function of the site and due to the movements of the vessel in this field. Furthermore, the magnetization of a very large object such as a vessel is not uniformly distributed throughout this object; consequently it must be neutralized at each point of the vessel in order to obtain a zero magnetic signature. In practice, it is thus not possible to suppress completely the magnetic signature of a vessel. Under most favorable circumstances it is possible to suppress its vertical component by creating a vertical magnetization compensating exactly the vertical component of the magnetization that is induced by the magnetic field of the earth, and it is possible to reduce its horizontal components by suppressing the horizontal components of the permanent magnetization.

Two types of devices allowing to reduce the magnetic signature of a vessel are already known: devices independent from the vessels and called demagnetization stations and devices installed on the vessels and called magnetic immunization devices. A device for the first type comprises a large installation situated in a port and allows to process different vessels at regular intervals.

A device of the second type allows to permanently neutralize the magnetic signature of a vessel by opposing thereto a magnetic field that is variable in function of the geographical position of the vessel and in function of its attitude with respect to the magnetic field of the earth. This second type of device is efficient but expensive in terms of material and energy. The vessels equipped with a magnetic immunization device are furthermore periodically processed in a demagnetization station in order to bring their permanent magnetization to a perfectly defined value, which facilitates the adjustment of their magnetic immunization device and allows to reduce its power consumption.

The device according to the invention is a device of the first type. Several devices constituting demagnetization stations for vessels are known. A first known device comprises: a current pulse generator; conductors connected to this generator and forming turns surrounding the vessel and forming a solenoid the great axis of which corresponds to the great axis of the vessel and magnetometers secured on the sea-bed in order to measure the magnetization of the vessel. An operator manually controls the current pulse generator in function of the measurements supplied by the magnetometers. The current pulses have a duration of about 30 seconds each, an alternately positive and negative polarity, and a decreasing amplitude from a value of about 4,000 amperes. Throughout the duration of each pulse the current intensity is constant and it is supplied by a rectifier device energized from the public power network. The device has the drawback of having a very long carrying out time since several days are needed to set and interconnect the leads or conductors, which are very heavy thick cables, and because thereafter a day is necessary for processing in order to obtain demagnetization. Furthermore, this device requires a very powerful electrical installation, of about 1 megawatt, since it has a very high power consumption during the period of current pulses. During the remainder of the time the high power electrical installation is redundant.

A second known device comprises: conductors placed on the sea-bed and forming turns having a vertical axis, and a sinusoidal alternate current generator having a frequency of about 1 Hz and an intensity of several thousand amperes. The vessel to be demagnetized passes above these turns in order to approach and then move away from them. The increase and then the decrease of the magnetic field provoked by the moving nearer then the moving apart of the vessel performs a neutralization of the three components of the magnetization of the vessel. This device also requires a high power electrical installation because of the large dimensions of the turns, for example 20 m$\times$20 m, and due to their distance with respect to the vessel. Furthermore, the demagnetization can be incorrectly performed if the vessel does not pass exactly along the plane of symmetry of the turns, and this device only allows demagnetization; it does not allow to apply a determined magnetization in order to neutralize the vertical component of the magnetization induced by the magnetic field of the earth.

A third known device comprises conductors forming turns folded over in the forms of a double-U shape surrounding a portion of the hull of the vessel and continually displaced along the length of this hull during an interval of time of about six minutes; and a generator of alternately positive and negative pulses having a frequency of about 0.5 Hz. This device is generally used for processing small craft, with an electrical power higher than 200 kW. Furthermore, this device does not allow to apply a determined magnetization for equally compensating the vertical component of the magnetization induced in the vessel by the magnetic field of the earth.

SUMMARY OF THE INVENTION

The aim of the present invention is to produce a demagnetization device requiring an installation having a lower electrical power than known devices in order to reduce the cost of this electrical installation, the device reducing the duration of processing for each vessel; and allowing to create a determined permanent magnetization in order to neutralize the vertical component of the magnetization induced in the vessel by the magnetic field of the earth. In order to achieve this aim, the device according to the invention comprises: an array of capacitors which is slowly charged by a relatively low power electrical installation and which is rapidly discharged, in several hundredths of milliseconds; electrical conductors forming turns much smaller in size than the length of the vessel in order to perform a localized processing of each portion of the vessel; and a servo-system allowing to automatize the processing by servo-controlling the charge voltage of the capacitors and the discharge current direction in function of the magnetization measured by the magnetometers, and in function of a reference value.

According to the invention, a demagnetization device, especially for demagnetizing vessels, comprising conductors forming turns placed in the vicinity of an object to be demagnetized and a generator for injecting current pulses into these conductors, comprises:

capacitors;

means for charging these capacitors at a determined voltage;

means of discharging these capacitors into the conductors;

at least one magnetometer for measuring the magnetization of the object to be demagnetized;

controlled means for servo-controlling the charge voltage of the capacitors in function of the magnetization measured by the magnetometer.

BRIEF DESCRIPTION OF THE DRAWINGS

FIG. 1 represents a schematic block diagram of an embodiment of the device according to the invention;

FIG. 2 represents the graph of a current pulse performed in this embodiment.

DESCRIPTION OF A PREFERRED EMBODIMENT

The embodiment represented in FIG. 1 is intended to demagnetize a vessel 1 in the horizontal directions and to confer thereupon a non zero predetermined magnetization in the vertical direction in order to compensate the magnetization induced by the magnetic field of the earth. This example comprises conductors 2 to 6 forming three sets of turns the axis of which are orthogonal to one another; five magnetometers 7 to 11, an input terminal 16 connected to a public electric distribution network, a direct current generator 17, an array of capacitors 18, a bridge switching device 19, an inductance coil 20, a switching device or switch 21 with two inputs and six outputs; a device 22 for servo-controlling the voltage charge of the array of capacitors 18; a computing device constituted essentially of a microprocessor 23; a screen and a keyboard 24.

The vessel 1 is processed by portions each of a length of about 20 meters. When one portion has been processed the conductors are displaced in order to process an adjacent portion or otherwise the vessel is displaced with respect to these conductors. The device allows to perform successively the demagnetization along three orthogonal axes corresponding to the three axes of the series of turns. The screen and the key-board 24 allow to supply to the demagnetization device a reference value determining the residual magnetization desired in the vertical direction in order to compensate the magnetization induced by the magnetic field of the earth.

A first set or series of turns is formed of conductors 6 installed on the sea bed and forming a square of 20 m×20 m. A second set of turns is constituted by two halves symmetrical with respect to the longitudinal axis of the vessel 1 and formed of square turns of 20 m×20 m the plane of which is parallel to the symmetry plane of the vessel and which are situated close to the sides of it. A third set of conductors 4 and 5 is situated in a plane perpendicular to the longitudinal axis of the vessel and passing through the centers of the turns formed by the conductors 2, 3 and 6. This third set of conductors comprises incomplete square turns formed of conductors 4 and other incomplete square turns formed of conductors 5 and intended to close on the circuits of the conductors 4. The conductors 4 form three sides of square turns having a size of 20 m×20 m with the upper side missing. The assembly of conductors 5 forms incomplete square turns remote from the conductors 4 so as not to disturb the magnetic field created by the conductors 4. The conductors 4 are intended to create a magnetic field in the direction of the longitudinal axis of the vessel 1. The conductors 2 and 3 are intended to create a magnetic field in the direction of the transversal axis of the vessel 1. The conductors 6 are intended to create a magnetic field in the vertical direction.

These three assemblies of conductors are each connected by two lines to the switching device 21 which receives on its two inputs current pulses that it transmits to one of the assemblies of conductors in function of a selection signal applied to a control input by the microprocessor 23. The five magnetometers 7 to 11 allow to measure the magnetic field created by the magnetization of the vessel 1. Each magnetometer supplies three measuring signals corresponding respectively to three components of the magnetic field, orthogonal two by two and parallel to the directions of the three magnetic fields created respectively by the three conductor assemblies.

The magnetometers are integral with the three assemblies of conductors and are situated below the vessel, at a level lower than the horizontal part of the turns formed by the conductors 4. In this embodiment, the lower part of the turns formed by the conductors 4, the lower part of the turns formed by the conductors 2 and 3, and the set of turns formed by the conductors 6 are located in the same plane which is lower than the hull of the vessel. The magnetometer 7 is placed on the axis of symmetry of the turns formed by the conductors 6, and the four other magnetometers are located at the same distance, of about 15 m, with respect to the magnetometer 7 and are in a horizontal plane passing through it. The magnetometers 8 and 10 are situated on a straight line passing through the magnetometer 7 and parallel to the longitudinal axis of the vessel whereas the magnetometers 9 and 11 are located on a straight line passing through the magnetometer 7 and perpendicular to this axis.

The screen and the key-board 24 are connected to the microprocessor 23 in order to receive data to be displayed on the screen and to transmit the orders given by the operator by typing on the key-board. The microprocessor 23 possesses a multiple input connected to the magnetometers 7 to 11 in order to receive their measuring signals, and an input connected to an output of the device 22 supplying a logic signal when the array of capacitors 18 is sufficiently charged. It is provided with an output connected to a control input of the servo-device 22 of the charge voltage in order to supply a signal of value $V_o$ determining the charge voltage of the array of capacitors 18; an output supplying a binary word P at a control input of the bridge switching device 19, in order to trigger the current flow in the assemblies of the conductors 2 to 6 with a selected direction, by controlling the closing of two branches of the bridge.

The generator 17 receives the electric energy supplied in 16 by the public network. It is provided with two electric outputs connected respectively to the two inputs of the array of capacitors 18. This is provided with two outputs connected respectively to two inputs of the device 19 and to two inputs of the servo-device 22. The device 19 is a bridge switching device, obtained for example by means of thyristors. It is provided with two outputs connected respectively to a first terminal of the inductance coil 20 and to a first input of the switch 21. A second terminal of the inductance coil 20 is connected to a second input of the switch 21. The switch 21 can be produced by means of thyristors, according to conventional techniques.

The servo-device 22 of the charge voltage of the array of capacitors 18 is provided with an output connected to a control input of the generator 17 in order to charge the array of capacitors 18 to a voltage corresponding to the value $V_o$ of the signal supplied by the microprocessor 23. This charge is performed approximately at constant current. When the charge of the array of capacitors 18 has reached the fixed value, the device 22 sends a logic signal to the microprocessor 23 and this signal can in turn trigger the sending of a current pulse into one of the assemblies of conductors by controlling the device 19.

The discharge circuit of the array of capacitors 18 is constituted by the device 19, the inductance 20, the switch 21 and the ohmic resistance of the assembly of conductors which is put into the circuit by means of the switch 21. The inductance of the conductors constituting the turns is negligible with respect to the value of the inductance coil 20 and the presence of the vessel 1 in the vicinity of the conductors slightly influences the total inductance of the circuit.

It is known that the discharge current of a capacitor of capacity C in a circuit having an inductance L and a resistance R can give rise to two different rates of discharge according to the damping value of the circuit. If the value R is lower than $2\sqrt{L/C}$ the current is a damped oscillator current. If the resistance R has a value higher than or equal to $2\sqrt{L/C}$ the current is constituted by a single pulse.

When the resistance R is equal to $2\sqrt{L/C}$ the damping is called critical. The intensity of the current in function of time is given by the formula:

$$i = \frac{C \cdot V_o}{\tau} \times \frac{t}{\tau} \times e^{\frac{-t}{\tau}} \qquad (1)$$

$V_o$ being the charge voltage of the capacitor at the instant $t=0$ and $\tau$ being the time constant L/R. The intensity of this current passes through a maximum for $t=\tau$ and has a value:

$$i_{max} = \frac{C.V_o}{\tau} \times \frac{1}{e} \qquad (2)$$

FIG. 2 represents the current pulse obtained for a critical damping. This figure represents the graph of the function:

$$\frac{\frac{i}{C.V_o}}{\tau}$$

in function of the variable: $x=t/\tau$

The current pulse obtained is not rectangular but it is nevertheless possible to define its duration by considering the interval of time during which the current intensity is equal to $i_{max}$ less 3 dB. This duration is equal to $1.7 \cdot \tau$. Experience has shown that a duration of about several hundreds of milliseconds is necessary to obtain an effective demagnetizing processing. For example, 500 ms is a duration realizing a good compromise between the effectiveness of the demagnetization and the electrical energy necessary to create this current pulse.

For example, for this duration of 500 ms the maximal intensity is equal to $31.12\ C \cdot V_o$. If this maximal intensity is fixed at 1,000 amperes, the initial charge $C \cdot V_o$ of the capacitors array 18 is equal to 800 coulombs. For a charge end voltage equal to 1,000 volts the capacity C must have a value of 0.8 Farads. In one embodiment, the charge time for obtaining this voltage is equal to 1.5 minutes and the initial charge current has an intensity of 50 amperes. The electrical power supplied by the installation is thus about 50 kW during the charge of the array of capacitors 18.

The device according to the invention can of course operate with a damping higher or lower than the critical damping value. In practice, the pulses of maximal efficiency are obtained when the discharge circuit has a damping value close to the critical damping value.

According to one variant of the invention, it is within the scope of the man skilled in the art to replace the inductance coil 20 by an adaptation circuit comprising several inductance coils and several capacitors with the purpose of supplying to the three assemblies of capacitors current pulses having a form similar to that of a rectangle.

In order to reduce as much a possible the power of the electrical installation, each portion of the vessel is processed according to three successive axes. However, it is possible to carry out the demagnetization simultaneously according to three axes by providing three arrays of independent capacitors, three independent charge devices and three independent discharge devices, controlled in parallel by a single computer.

The magnetometers 7 to 12 allow to measure the magnetization of the vessel during processing. The magnetometers 8 and 10 allow to take into account respectively the magnetization of the portion which was processed immediately prior to and the magnetization of the portion to be treated immediately afterwards. The magnetometers 9 and 11, that are transversaly shifted with respect to the magnetometer 7, allow to take into account the lack of homogeneity of the magnetization in the portion of the vessel being processed.

The processing of a portion of a vessel starts by measuring its magnetization. The measuring signals supplied by the magnetometers 7 to 11 allowing the computing device 23 to determine, for the three directions the polarity and the intensity $i_{max}$ of the current for a first demagnetization pulse. This intensity is proportional to the magnetization measured in the corresponding direction. The formula (2) allows to cause $i_{max}$ to correspond to a value $V_o$ of this end of charge voltage of the array of capacitors 18. When this charge voltage is reached the servo-device 22 supplies a logic signal to the microprocessor 23. This latter can then trigger the discharge.

After the discharge of a first current pulse, a measurement of residual magnetization is made in the involved direction. The microprocessor 23 determines an intensity value $i_{max}$ for a second demagnetization pulse and deducts from it the value $V_o$ of the end of charge voltage of the array of capacitors 18. When the array of capacitors 18 has reached the voltage $V_o$, the servo-device 22 warns the microprocessor 23 which can then trigger the discharge of a second pulse. This sequence is repeated until the magnetization, in the direction involved, has been brought to the reference value set by the operator. This reference value is zero for the horizontal components and non zero for the vertical component. The value of th vertical component of the permanent magnetization is selected in function of the zone in which the vessel must navigate.

The estimation of the magnetization of the portion of the vessel to be processed is carried out from measurements of the magnetic field, in three directions, by five magnetometers 8 to 11, based upon the hypothesis that the barycenter of the magnetic masses corresponds to barycenter G of the vessel's hull. The components Mx, My, Mz of the magnetization in this point G are associated to the values $B_x$, $B_y$, $B_z$, of the magnetic field measured by one of the magnetometers by the known relations:

$$B_x = \frac{\mu o}{4\pi} \cdot \frac{1}{r^5} \{3 \cdot x \cdot y \cdot M_y + (2x^2 - y^2 - z^2)M_x + 3 \cdot x \cdot z \cdot M_z\}$$

$$B_y = \frac{\mu o}{4\pi} \cdot \frac{1}{r^5} \{(2y^2 - x^2 - z^2) \cdot M_y + 3 \cdot x \cdot y \cdot M_x + 3 \cdot y \cdot z \cdot M_z\}$$

$$B_z = \frac{\mu o}{4\pi} \cdot \frac{1}{r^5} \{3 \cdot x \cdot z \cdot M_y + 3 \cdot x \cdot z \cdot M_x + (2z^2 - x^2 - y^2)M_z\}$$

in which x, y, z are coordinates of the magnetometer in an orthostandard reference situated in G and in which r is the distance between the magnetometer and the point G. The values x, y, z, r being known, for each magnetometer, there is to be solved a system of 15 equations with three unknown factors. It can be solved by the classical method known as the method of the smallest squares, for example. The programming of the microprocessor 23 to apply this method is within the scope and knowledge of those skilled in the art.

To neutralize one of the components $M_x$, $M_y$, $M_z$, of the magnetization, it is necessary to create a magnetization exactly opposed by means of one of the sets of turns. There exists a theoretically known relationship between the intensity in these turns and the magnetization created, this intensity can thus can be calculated. According to formula (2), the end of charge voltage $V_o$ is thus proportional to the value of this component, but the proportionality coefficient cannot be calculated exactly since it depends upon the form of the turn and the position of the vessel with respect to the turns, which are not exactly known.

In practice, this coefficient is determined by a very approximative calculation or by a test, in each of the three directions. It is stored in the memory of the microprocessor. The inaccuracy of this coefficient does not raise any problem since the device demagnetizes the portion of the vessel by successive approximations by causing to lead the horizontal components of the magnetization towards zero and by causing the vertical components to lead towards the reference value. One simple embodiment consists therefore in programming the microprocessor 23 in order to compute three values of the charge voltage according to the formulae:

$$V_o = k_x \cdot M_x$$

$$V_o = k_y \cdot M_y$$

$$V_o = k_z \{M_z - C\}$$

in which $k_x$, $k_y$, $k_z$ are three constant coefficients corresponding respectively to the two horizontal directions and to the vertical direction. For this latter, the constant C is a reference value, not zero, supplied by the operator by means of the key-board 24 in order to obtain a determined vertical component.

The continuation of the current pulses to process each portion of the vessel can be automatically controlled by the microprocessor 23, without any intervention by an operator, or the microprocessor can await a command given by the operator prior to triggering each pulse. The microprocessor 23 can display on the screen 24 the values of the measured magnetization, in order to allow the operator to control the sequence of the demagnetizing processing.

We claim:

1. Demagnetizing device, especially for vessels, comprising: conductors forming turns placed in the vicinity of an object to be demagnetized;
- capacitors;
- means for charging the capacitors to a determined voltage;
- means for discharging the capacitors into the conductors;
- at least one magnetometer for measuring the magnetization of the object to be demagnetized;
- and means for servo-controlling the charge voltage of the capacitors as a function of the magnetization measured by the magnetometer.

2. Device according to claim 1, wherein the conductors form three sets of turns having axes which are orthogonal to one another and allowing to create respectively three components of a magnetic field in a single portion of the object, the conductors being displaced with respect to the object to successively demagnetize all the portions of said object, and wherein the magnetometer supplies three measuring signals corresponding to the three orthogonal components of the magnetization of the object in three directions parallel to the magnetic fields generated respectively by the three sets of turns formed by the conductors.

3. Device according to claim 2, in wherein the means for servo-controlling the charge voltage comprise computing means having an input connected to the magnetometer in order to receive a measuring signal of the magnetization in each of the three directions, and having two outputs connected respectively to an input controlling the means for servo-controlling the charge voltage and to an input controlling the means for discharging, in order to supply them respectively with a first signal the value $V_o$ of which determining the end of charge voltage value of the capacitors, and with a second signal P determining the current direction of discharge in the conductors, said signals being determined for each direction in function of the measuring signal of magnetization in the direction involved.

4. Device according to claim 3, wherein the computing device determines, for each direction, a signal P in function of the sign of the measured magnetization and determines a value $V_o$ proportional to the absolute value of the difference between a reference value and the modulus of the component of the measured magnetization, in order to cause this difference to leads towards zero by realizing successively several discharges for a single direction and for a single portion of the object.

5. Device according to claim 4, wherein said magnetometers are disposed in the vicinity of the object to be demagnetized, whereby the magnetization of the object can be estimated from the measurements at several distinct points.

* * * * *